United States Patent [19]

Gallo

[11] Patent Number: 4,607,845

[45] Date of Patent: Aug. 26, 1986

[54] SLIDE NUMBER IDENTIFIERS

[76] Inventor: William Gallo, 619 Rose St., Apollo, Pa. 15613

[21] Appl. No.: 663,489

[22] Filed: Oct. 22, 1984

[51] Int. Cl.[4] ..... A63F 3/06

[52] U.S. Cl. ..... 273/148 R

[58] Field of Search ..... 273/148 R, 269

[56] References Cited

U.S. PATENT DOCUMENTS

| | | | |
|---|---|---|---|
| 3,013,349 | 12/1961 | Cooper | 273/148 R X |
| 3,113,779 | 12/1963 | Guenther | 273/148 R |
| 3,902,656 | 9/1975 | Rothchild | 229/75 |
| 4,132,348 | 1/1979 | Bromberg | 229/75 |
| 4,161,330 | 7/1979 | Ross | 283/55 |
| 4,270,772 | 6/1981 | Bodily | 283/1 |

FOREIGN PATENT DOCUMENTS

| | | | |
|---|---|---|---|
| 2401678 | 4/1979 | France | 273/148 R |
| 2509187 | 1/1983 | France | 273/148 R |

*Primary Examiner*—Anton O. Oechsle

*Attorney, Agent, or Firm*—Buell, Ziesenheim, Beck & Alstadt

[57] ABSTRACT

A slide number identifier is provided for elongate multi-number set lottery cards having said sets extending transversely of the card in succession comprising a single blank of plastic having at least two rectangular panels, at least one of which is translucent, said at least one translucent panel having sets of lottery numbers printed thereon in the alignment of a single transverse set of numbers as used on a lottery card with which the slide number identifier is to be used, said at least two panels being folded to side-by-side relation to form a sleeve through which the lottery card may be passed longitudinally and each transverse number set on the card aligned with the number sets on the translucent panel.

2 Claims, 4 Drawing Figures

SLIDE NUMBER IDENTIFIERS

This invention relates to slide number identifiers and particularly to a slide member for quickly indexing and identifying the numbers in a lottery ticket such as that used by many states in their lottery game known as "Lotto".

Generally, slide calculators of various types have been available over the years for rapidly performing calculations of one sort or another, either generally or for specific purposes. Most people are aware of slide rules of classical shape having a wooden, metal or plastic body with logarithmic functions and various mathematical indicia printed thereon, a second wooden, metal or plastic smaller body with matching mathematical indicia slidable in a longitudinal slot in the main body and having a sliding glass or clear plastic index number sliding over both. There are, however, many other forms of slide calculators. For example, U.S. Pat. No. 3,902,656 provides a slide calculator having a foldable cardboard blank with certain panels foldable together to define a tubular envelope and a panel foldable therein to become a slide within the envelope. U.S. Pat. No. 4,132,348 l describes still another form of slide calculator in which two contiguous leaf members of a sheet are separable and foldable to become a separate slide and sleeve for a calculator for printed information readout. Such devices have a punched opening or otherwise formed window in the envelope or sleeve designed to align with specific information on the slide. There have been many other similar calculators proposed over the years. There have, however, been, to my knowledge, no slide number identifiers available for rapidly and accurately identifying a plurality of numbers such as those on a lottery card.

In the usual lottery card as used by the various states in playing "Lotto", there are two sets of 40 numbers, one above the other in horizontal rows of 8 numbers and vertical rows of 5 numbers. These sets appear in groups of four per card. The winning numbers are generally given to the public by a media announcement on the day of a drawing or shortly thereafter, after which it is the player's duty to match them with his or her card. This can be a time consuming and boring job. The present invention provides a solution to that problem.

I provide a slide number identifier receiving an elongate lottery card comprising a single blank of plastic having at least two rectangular panels, one of which is translucent, said one panel having sets of lottery numbers printed thereon in the alignment of a single set of numbers as used on the lottery card received in the slide number identifier, said panels being folded to form an envelope through which the lottery card can be slidably passed and each set of numbers aligned with the set of numbers on the translucent panel. Preferably, the translucent panel has a third smaller panel or tab on the side opposite its connection with the other panel, which third panel is folded parallel to the fold between the two panels to overlay the other panel and formed a sleeve through which a lottery card may be passed. The translucent panel may also be provided with a section on which the lottery numbers may be written. The other member other than the translucent member may be printed with instructions for use of the apparatus.

In the foregoing general outline of my invention I have set out certain objects, purposes and advantages of my invention. Other objects, purposes and advantages of this invention will be apparent from a consideration of the following description and the accompanying drawings in which.

Figure 1:
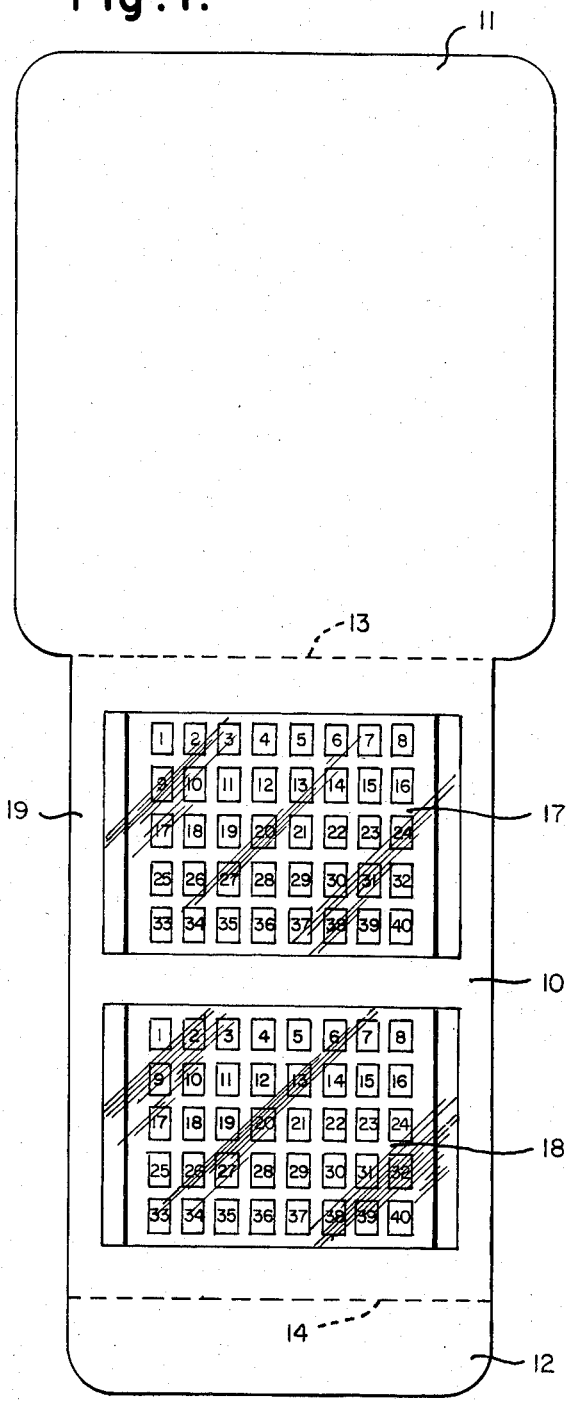
FIG. 1 is a plan view of a slide number identifier according to this invention.

Referring to the drawings, I have illustrated a slide number identifier according to my invention as a single blank of plastic having a translucent panel 10, a back panel 11 and a smaller closing panel 12 foldable along lines 13 and 14 to form a closed flat sleeve or envelope having a passage 15 receiving a lottery card 16. The translucent face is provided with two windows 17 and 18, each having a set of 40 numbers, one above the other in the precise alignment used in lottery card 16. These windows are outlined by a colored coating 19 on translucent panel 10. The illustrated format is the one presently used by the Commonwealth of Pennsylvania in its "Lotto" lottery and is generally the same as that used for the like lottery in other states. The translucent face may be marked in each set 17 and 18 with pencil to indicate the winning numbers and the lottery card 16 inserted in passage or slot 15 until the numbers of each set align with the numbers of the player so his numbers can be quickly checked.

Figure 3:
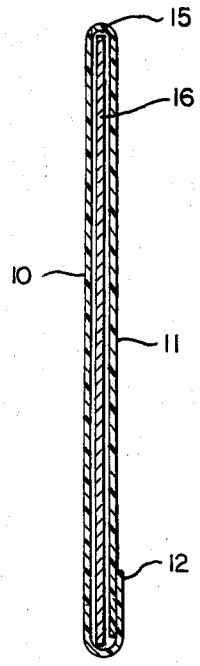
FIG. 3 is a sectional view on the line III—III of FIG. 2.
Figure 2:
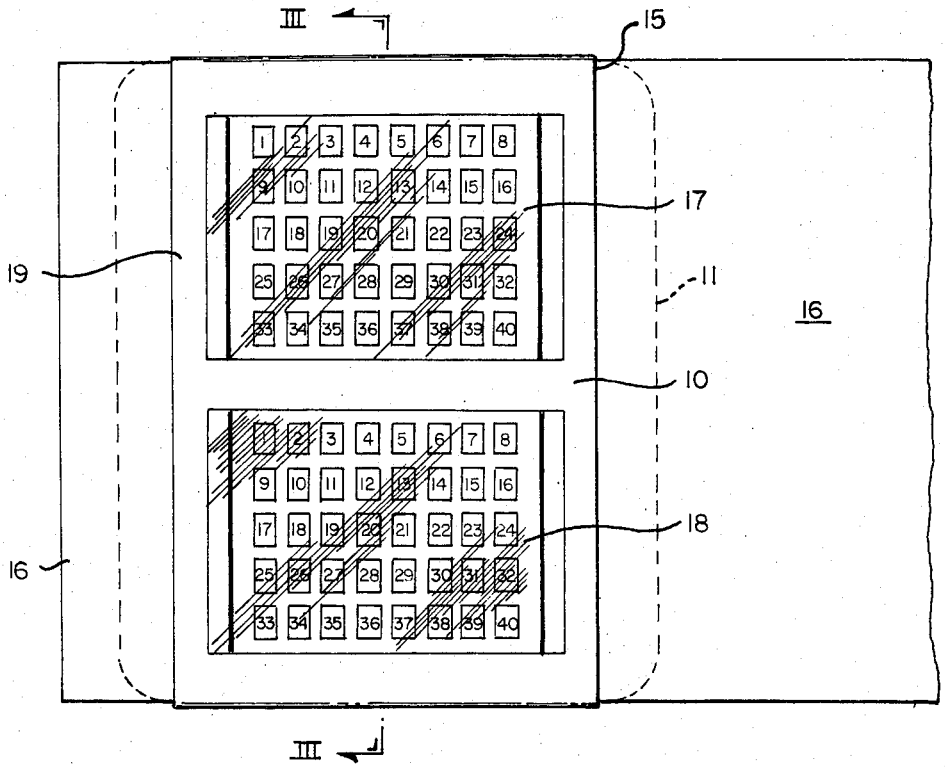
FIG. 2 is an elevational view of a slide number identifier assembled from the blank of FIG. 1 showing a lottery card in place.
Figure 4:
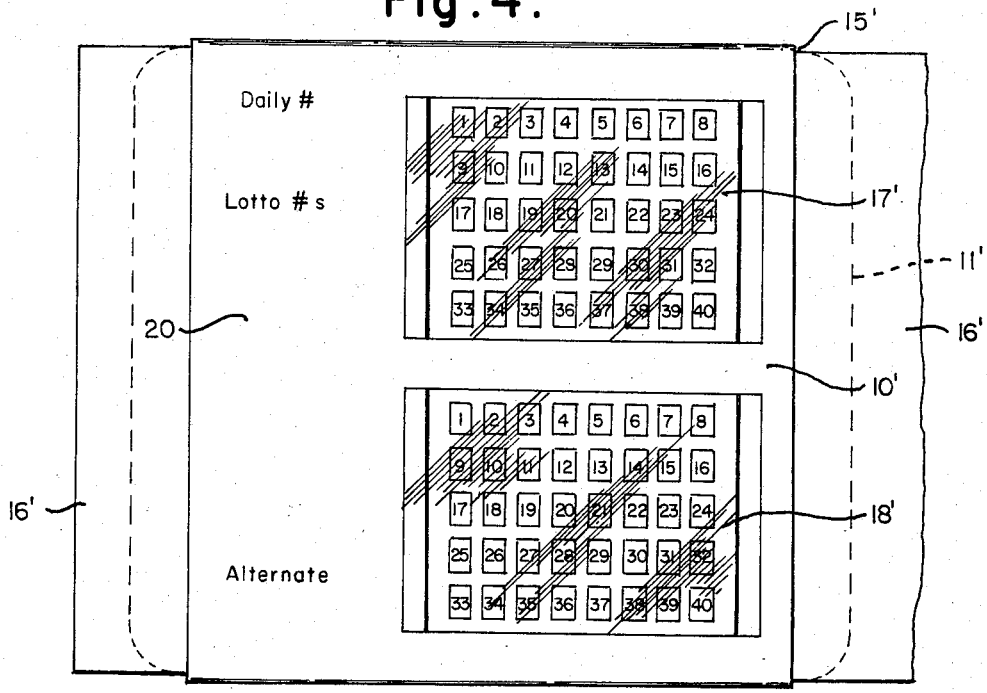
FIG. 4 is an elevational view of a second embodiment of slide number identifiers according to this invention.

In the embodiment of FIG. 4, I have illustrated another embodiment in which those parts which correspond to parts in FIGS. 1–3 bear like numbers with a prime sign. This embodiment differs from that of FIGS. 1–3 in having a wide coated section 20 on the translucent panel 10 on one side of windows 17' and 18' to provide an area on which the winning lottery numbers can be removably added for convenience.

In the foregoing specification I have set out certain preferred practices and embodiments of this invention, however, it will be understood that this invention may be otherwise embodied within the scope of the following claims.

I claim:

1. A slide number identifier for elongate multi-number set lottery cards having said sets extending transversely of the card in succession comprising a single blank of plastic having a first rectangular panel, a second rectangular panel of generally equal size extending from one side of said first panel and a third smaller panel extending from an opposite side of said first panel, said first panel having two spaced-apart translucent windows therein each window outlined by a colored coating and each having a set of lottery numbers printed thereon in the alignment of a single transverse set of numbers as used on a lottery card with which the slide number identifier is to be used, said first panel having a wide coated section adjacent said windows to provide an area on which winning lottery numbers may be removably written, said first and second panels being folded to side-by-side relation and said third panel being folded so as to overlap the end of said second panel so as to form a closed sleeve through which the lottery card may be passed longitudinally and two sets on the card may be aligned respectively with the number sets on the two spaced-apart windows whereby two separate and complete sets of numbers on the card are each independently outlined by the colored coating of the first panel.

2. A slide member as claimed in claim 1 wherein the second panel is provided with printed operating instructions.

* * * * *

UNITED STATES PATENT AND TRADEMARK OFFICE

CERTIFICATE OF CORRECTION

PATENT NO. : 4,607,845

DATED : August 26, 1986

INVENTOR(S) : WILLIAM GALLO

It is certified that error appears in the above-identified patent and that said Letters Patent is hereby corrected as shown below:

Column 1, line 24, change "4,132,348 1" to --4,132,348--.

Signed and Sealed this

Eleventh Day of November, 1986

*Attest:*

DONALD J. QUIGG

*Attesting Officer* *Commissioner of Patents and Trademarks*